United States Patent [19]

Kernodle

[11] Patent Number: 4,935,854

[45] Date of Patent: Jun. 19, 1990

[54] PORTABLE UTILITY LAMP

[76] Inventor: Gerald W. Kernodle, 5371 S. Berry La., Hubbard, Oreg. 97032

[21] Appl. No.: 436,736

[22] Filed: Nov. 15, 1989

[51] Int. Cl.[5] ..... F21V 21/00

[52] U.S. Cl. ..... 362/275; 362/61; 362/220; 362/250; 362/419

[58] Field of Search ..... 362/220, 250, 275, 287, 362/419, 426, 427, 431, 449, 804, 33, 61

[56] References Cited

U.S. PATENT DOCUMENTS

| | | | |
|---|---|---|---|
| 2,215,531 | 9/1940 | Pieper | 362/804 X |
| 2,553,094 | 5/1951 | Jarett et al. | 362/322 |
| 3,008,742 | 11/1961 | Goldstein | 362/431 X |
| 3,535,509 | 10/1970 | Thornton | 362/220 |
| 3,670,156 | 6/1972 | Schmidt | 362/127 |
| 4,200,903 | 4/1980 | Koenig et al. | 362/134 |
| 4,658,337 | 4/1987 | Burke | 362/225 |
| 4,803,606 | 2/1989 | Rotter | 362/419 X |

*Primary Examiner*—Stephen F. Husar
*Attorney, Agent, or Firm*—Jerry T. Kearns

[57] ABSTRACT

A portable utility lamp has a rectangular frame provided with a plurality of wheels for movement across a floor surface. A plurality of vertically extensible posts are mounted on the frame and rotatably support a lamp housing. A pair of frictional clamping disks are forced into abutment by manually tightened clamping nuts to secure the rotatable housing in an adjusted position. The center of mass of the lamp housing is disposed on the longitudinal axis of the clamping bolts to provide a balanced weight distribution which allows adjustment of the lamp housing with a minimum of effort. The extensible posts each include a tubular stationary member having an extensible member received for sliding movement therein. A coil spring biases the extensible member upwardly, and a retaining pin is receivable through one of a plurality of spaced apertures provided in the extensible member to retain the lamp housing at a selected elevation. The utility lamp is particularly adapted for illuminating the undercarriage of a vehicle raised on a garage lift, and for a variety of other diverse uses.

17 Claims, 4 Drawing Sheets

PORTABLE UTILITY LAMP

BACKGROUND OF THE INVENTION

1. Field of the Invention

The present invention relates to portable utility lamps, and more particularly pertains to a portable utility lamp which is vertically and rotatably adjustable which is mounted on a frame including a plurality of wheels to enable convenient portability, enabling use in a wide variety of environments.

2. Description of the Prior Art

Various types of portable utility lamps are known in the prior art. A typical example of such a portable utility lamp is to be found in U.S. Pat. No. 2,553,094, which issued to J. Jarrett et al on May 15, 1951. This patent discloses a floor standing lamp having an elongated pivotally adjustable lamp housing formed as an open reflector hood. U.S. Pat. No. 3,535,509, which issued to A. Thornton on Oct. 20, 1970, discloses a portable utility lamp including a vertically adjustable post extending upwardly from a wheeled frame. A reflector hood is pivotally mounted on the vertical post. U.S. Pat. No. 3,670,156, which issued to D. Schmidt on June 13, 1972, discloses a portable utility lamp mounted on a wheeled tool cabinet having a vertically adjustable post and a transverse lamp mounting arm secured thereto. U.S. Pat. No. 4,200,903, which issued to T. Koenig et al on Apr. 29, 1980, discloses a utility lamp supported within a rectangular housing mounted by a plurality of vertical legs. An internal arcuate reflector directs light upwardly through a transparent top wall of the housing. U.S. Pat. No. 4,658,337, which issued to L. Burke on Apr. 14, 1987, discloses a portable utility lamp including a pair of hingedly connected elongated frame sections adapted to be oriented in an A-frame configuration in use. Elongated fluorescent lamps extend along each frame section.

While the above mentioned devices are directed to portable utility lamps, none of these devices disclose a portable utility lamp having an elongated reflector lamp housing mounted for rotation by a frictional clamping mechanism and having a center of mass disposed on an axis of a clamping bolt to minimize adjustment effort. Additionally, none of the aforementioned devices disclose the use of vertically adjustable posts having extensible members biased upwardly to facilitate vertical adjustment of a lamp housing. Inasmuch as the art is relatively crowded with respect to these various types of portable utility lamps, it can be appreciated that there is a continuing need for and interest in improvements to such portable utility lamps, and in this respect, the present invention addresses this need and interest.

SUMMARY OF THE INVENTION

In view of the foregoing disadvantages inherent in the known types of portable utility lamps now present in the prior art, the present invention provides an improved portable utility lamp. As such, the general purpose of the present invention, which will be described subsequently in greater detail, is to provide a new and improved portable utility lamp which has all the advantages of the prior art portable utility lamps and none of the disadvantages.

To attain this, representative embodiments of the concepts of the present invention are illustrated in the drawings and make use of a portable utility lamp which has a rectangular frame provided with a plurality of wheels for movement across a floor surface. A plurality of vertically extensible posts are mounted on the frame and rotatably support a lamp housing. A pair of frictional clamping disks are forced into abutment by manually tightened clamping nuts to secure the rotatable housing in an adjusted position. The center of mass of the lamp housing is disposed on the longitudinal axis of the clamping bolts to provide a balanced weight distribution which allows adjustment of the lamp housing with a minimum of effort. The extensible posts each include a tubular stationary member having an extensible member received for sliding movement therein. A coil spring biases the extensible member upwardly, and a retaining pin is receivable through one of a plurality of spaced apertures provided in the extensible member to retain the lamp housing at a selected elevation. The utility lamp is particularly adapted for illuminating the undercarriage of a vehicle raised on a garage lift, and for a variety of other diverse uses.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the public generally, and especially those who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved portable utility lamp which has all the advantages of the prior art portable utility lamps and none of the disadvantages.

It is another object of the present invention to provide a new and improved portable utility lamp which may be easily and efficiently manufactured and marketed.

It is a further object of the present invention to provide a new and improved portable utility lamp which is of a durable and reliable construction.

An even further object of the present invention is to provide a new and improved portable utility lamp which is susceptible of a low cost of manufacture with regard to both materials and labor, and which accordingly is then susceptible of low prices of sale to the consuming public, thereby making such portable utility lamps economically available to the buying public.

Still yet another object of the present invention is to provide a new and improved portable utility lamp which provides in the apparatuses and methods of the prior art some of the advantages thereof, while simultaneously overcoming some of the disadvantages normally associated therewith.

Still another object of the present invention is to provide a new and improved portable utility lamp which is vertically adjustable with a minimum of effort.

Yet another object of the present invention is to provide a new and improved portable utility lamp which is rotationally adjustable with a minimum of effort.

Even still another object of the present invention is to provide a new and improved portable utility lamp which is mounted on a wheeled frame for vertical and rotational adjustment to enable use in a variety of different environments.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
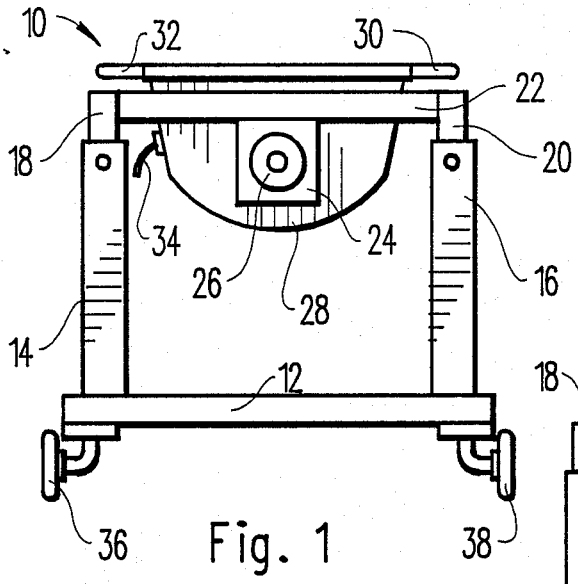
FIG. 1 is an end view of the portable utility lamp according to a first embodiment of the present invention.

With reference now to the drawings, and in particular to FIG. 1 thereof, a new and improved portable utility lamp embodying the principles and concepts of the present invention and generally designated by the reference numeral 10 will be described.

More specifically, it will be noted that the first embodiment 10 of the invention includes a lower open rectangular frame, of which a frame rail member 12 is illustrated in the end view of FIG. 1 A plurality of castor wheels, of which two are illustrated at 36 and 38, are provided on the lower rectangular frame and support the portable utility lamp for movement across horizontal floor surfaces. In the first embodiment 10, a vertical post extends upwardly from each corner portion of the lower frame. The corner posts each include a stationary tubular member, for example 14 and 16, in which associated extensible members 18 and 20 are received for axial sliding movement. An end rail member 22 extends transversely between the extensible members 18 and 20. It should be noted that a symmetrical construction is provided at the opposite end of the lower frame of the portable utility lamp 10. A mounting tab 24 in the form of a metal plate is stationarily secured to the end rail member 22 and serves as a mounting surface for the lamp housing 28. As shown, the lamp housing 28 has an arcuate configuration so as to form a reflecting housing for conventional fluorescent tubular electric lamps. A pair of elongated handles 30 and 32 extend along opposite sides of the lamp housing 28, and allow manual rotation of the lamp housing 28 with respect to the mounting plate 24. A manually releasable clamping nut 26 is provided for retaining the housing 28 in a selected adjusted position, in a manner to be described and illustrated subsequently in greater detail. A power cord 34 extends into the lamp housing 28, and is adapted for connection to a conventional AC electrical outlet.

Figure 2:
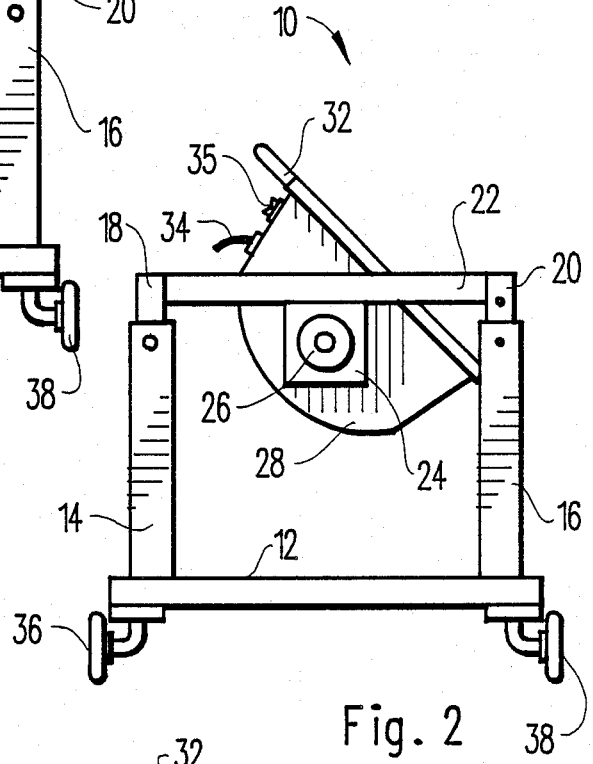
FIG. 2 is an end view, similar to FIG. 1, illustrating the lamp housing rotated to a different position.

FIG. 2 illustrates the lamp housing 28 rotated to an angular position. A rocker type power switch 35 may be provided for controlling lamps within the interior of the housing 28.

Figure 3:
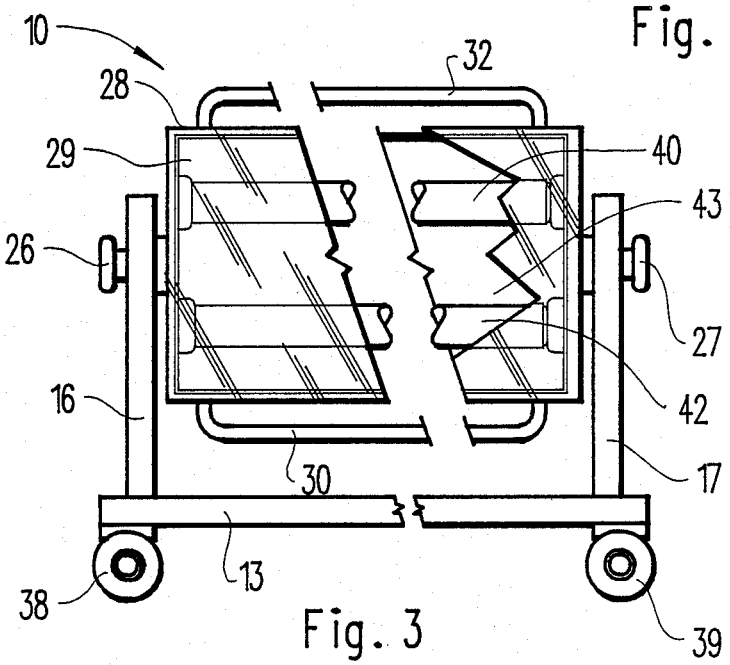
FIG. 3 is a side view, partially cut away, illustrating the portable utility lamp of FIG. 1.

FIG. 3 is a side view of the portable utility lamp 10 which illustrates tubular fluorescent lamps 40 and 42 mounted within the hollow interior of the housing 28. A transparent cover 29 encloses the hollow interior of the housing 28. Vertical posts 16 and 17 are illustrated at opposite ends of the housing. One 13 of a pair of parallel side frame members is depicted, extending between castor wheels 38 and 39. A similar clamping nut 27 is provided at an end of the housing 28 opposite the clamping nut 26.

Figure 4:
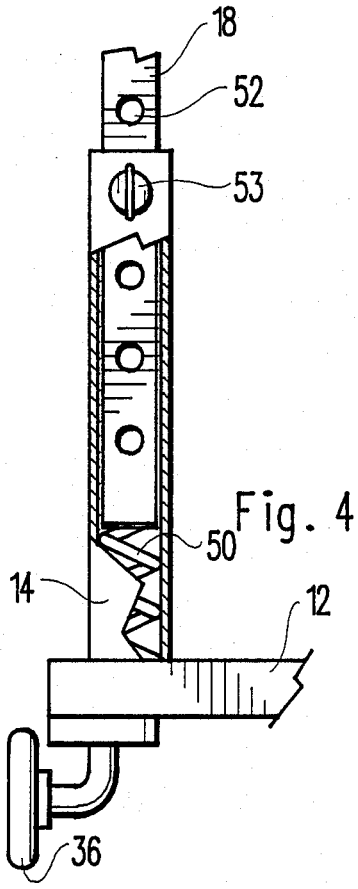
FIG. 4 is a detail view, partially cut away, illustrating the vertically adjustable lamp housing supporting post.

FIG. 4 is a detail view, which illustrates the vertical adjustment mechanism of a representative one of the vertical posts. The stationary tubular member 14 is secured to the frame end rail 12 at a corner portion thereof. The extensible member 18 is received for sliding movement within the interior of the tubular member 14. A coil spring 50 biases the extensible member 18 upwardly, and facilitates extension of the member 18 against the weight of the lamp housing. A retaining pin 53 is inserted through a transverse aperture formed in an upper portion of the stationary member 14, and through an aligned one of a plurality of spaced transverse apertures 52 formed through the extensible member 18.

Figure 5:
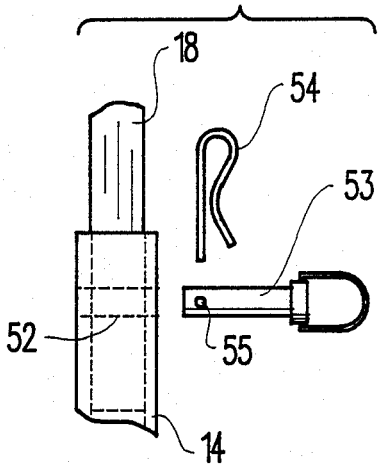
FIG. 5 is an exploded detail view, illustrating a retaining pin for securing the vertical post in a selected position.

FIG. 5 further illustrates the manner of installing the retaining pin 53 through the tubular member 14 and extensible member 18. The retaining pin 53 may be provided with an aperture 55 for engagement with a conventional cotter pin 54.

Figure 6:
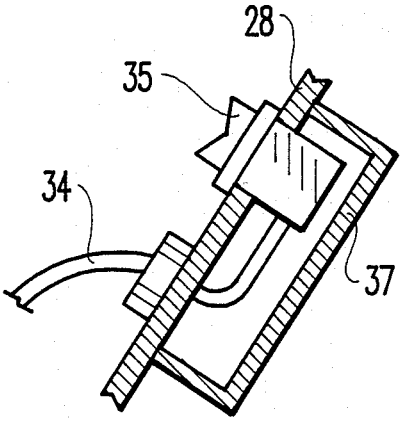
FIG. 6 is a cross sectional detail view, illustrating the lamp switch and power cord connection.

FIG. 6 illustrates the connection of the power cord 34 to the rocker switch 35 within a box 37 formed within the interior of the lamp housing 28.

Figure 7:
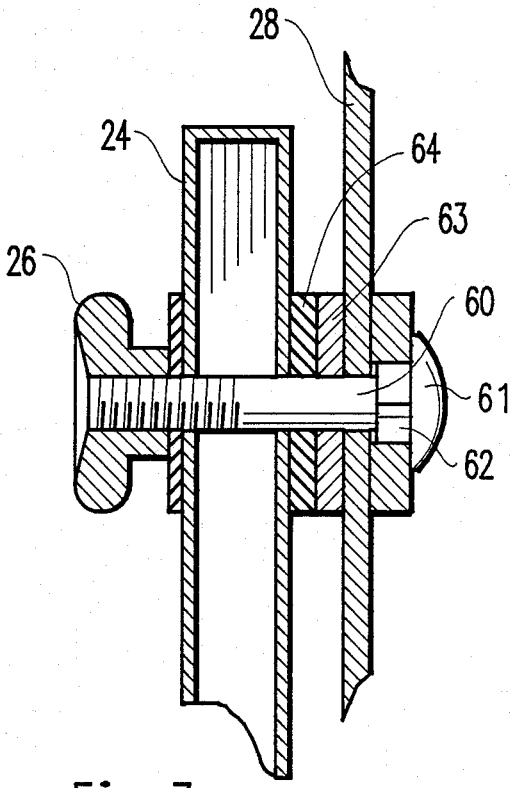
FIG. 7 is a cross sectional detail view, illustrating the rotational lamp housing adjustment mechanism.

FIG. 7 is a cross sectional detail view which illustrates the adjustable rotational mounting of the lamp housing 28 with respect to the mounting plate or tab 24. The clamping bolt 60 includes an enlarged head 61 having a hexagonal portion 62. The hexagonal portion 62 is secured to the end wall of the housing 28 such that the clamping bolt 60 is captured against rotation. The clamping bolt 60 extends through a pair of disks 63 and 64 which are formed from a friction enhancing material. To this end, the plate 63 may be formed from metal and the plate 64 may be formed from rubber. Alternatively, both of the plates 63 and 64 may be formed from a brake pad type material. The clamping bolt 60 extends completely through the mounting plate or tab 24 and is in threaded engagement with the clamping nut 26. The clamping nut 26 is manually tightened to an extent sufficient to force the frictional disks 63 and 64 into abutment with a force sufficient to just restrain rotation of the housing 28 against the force of gravity. This allows the housing 28 to be manually adjusted, and to be subsequently retained in the adjusted position without requiring additional clamping action. To further ease of adjustability, the housing 28 is preferably formed so as to dispose the center of mass of the lamp housing 28 on the longitudinal axis of the clamping bolt 60. It should be noted that the rotational supporting mechanism for the opposite end of the lamp housing 28 is similarly constructed.

Figure 8:
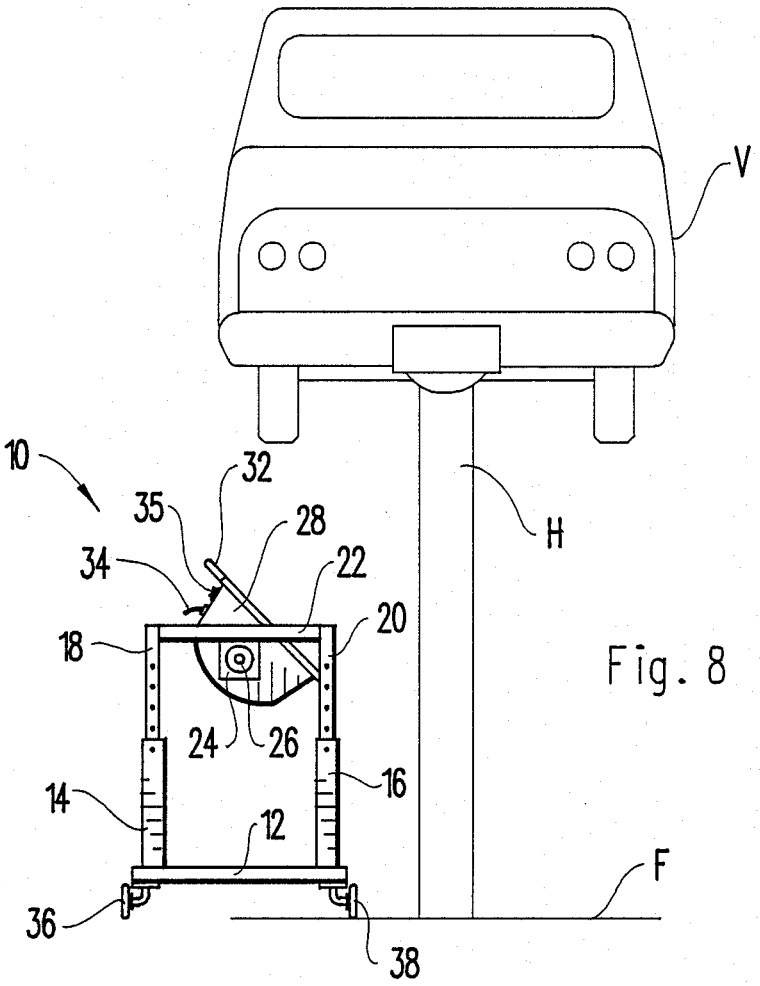
FIG. 8 is an end view, illustrating an example manner of use of the portable utility lamp according to the first embodiment of the present invention.

FIG. 8 illustrates an example manner of use of the portable utility lamp 10. The lower frame portion of the lamp 10 is wheeled along the floor F of a garage to a position adjacent a vehicle hoist H upon which a vehicle V is supported in a raised position. The lamp housing 28 is then rotated to a selected adjusted position to illuminate the undercarriage of the vehicle V to facilitate various vehicle service operations. It should be noted that the extensible members 18 and 20 of the vertical posts 14 and 16 have been extended to a raised position.

Figure 9:
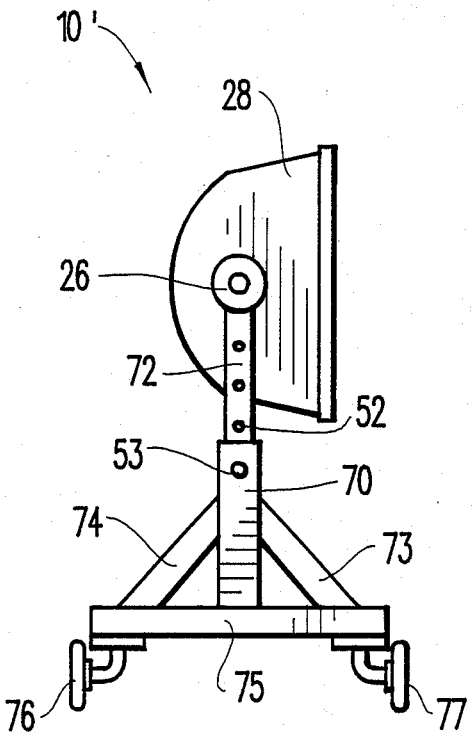
FIG. 9 is an end view, illustrating a portable utility lamp according to a slightly modified second embodiment of the present invention.

FIG. 9 illustrates a portable utility lamp 10' according to a slightly modified second embodiment of the present invention, in which similar parts have been identified with the previously designated reference numerals. In this construction, the lower rectangular frame has a pair of parallel frame end members, one of which is illustrated at 75, and is provided with a plurality of castor wheels, of which two, 76 and 77, are illustrated. A pair of vertical posts, one of which is illustrated at 70, are secured to the end frame members, for example 75. Diagonal brace struts 73 and 74 are secured, for example by welding, between the end member 75 and the vertical post 70. An extensible member 72 is slidably received within the tubular post 70 and is provided with a plurality of spaced apertures 52 adapted for cooperation with a transverse retaining pin 53.

Figure 10:
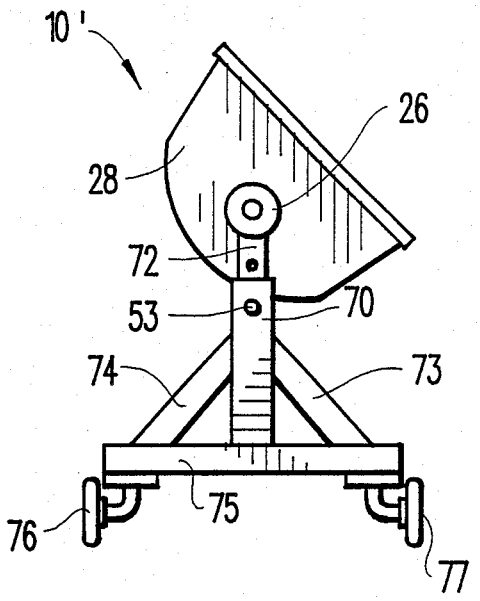
FIG. 10 is an end view, similar to FIG. 9, illustrating the lamp housing rotated to a different position.

FIG. 10 illustrates the lamp housing 28 pivoted to a different angular orientation, and with the extensible member 72 in a retracted position.

Figure 11:
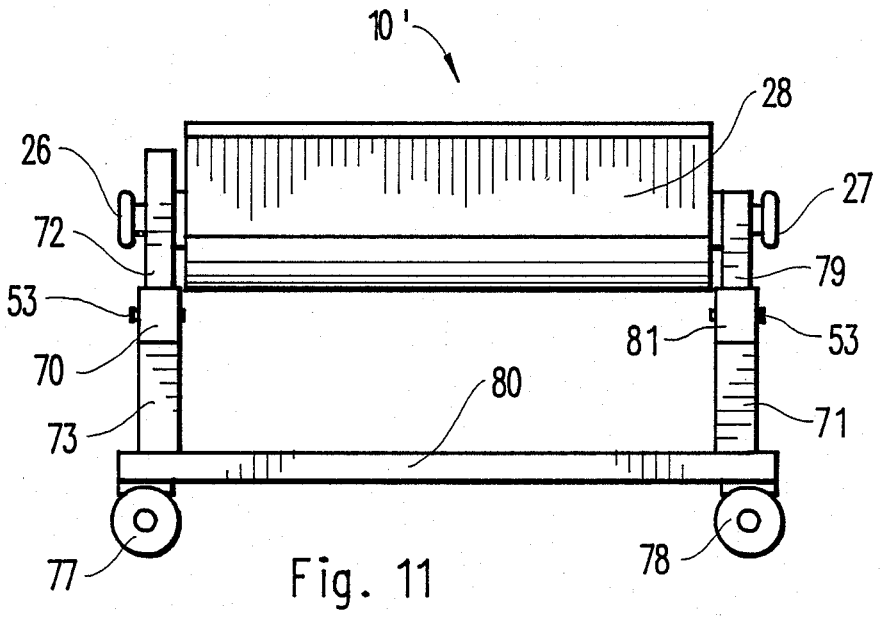
FIG. 11 is a side view, illustrating the portable utility lamp of FIG. 9.

FIG. 11 illustrates a side view of the portable utility lamp 10' which depicts the vertical posts 71 and 73. One of a pair of parallel side rail frame members 80 is shown. Castor wheels 77 and 78 are provided at corner portions of the lower rectangular frame. The clamping nuts 26 and 27 are disposed at opposite ends of the lamp housing 28. Extensible members 72 and 79 are secured at selected adjusted positions by retaining pins 53 extending transversely through stationary posts 70 and 81. Diagonal braces 71 and 73 support the stationary members 70 and 81. As with the first embodiment 10, the second embodiment 10' may utilize captured coil springs within the stationary post members 70 and 81, in the manner illustrated in FIG. 4, to assist in vertical adjustment of the lamp housing 28.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A portable utility lamp, comprising:
a frame having a rectangular configuration;
a vertically adjustable post mounted adjacent each corner of said frame;
a plurality of wheels on said frame;
a lamp housing;
means mounting said lamp housing for vertical adjustment with said posts;
means mounting said lamp housing for rotation about a horizontal axis;
at least one lamp in said housing;
first retaining means for retaining said posts in a selected vertically adjusted position;
and
second retaining means for retaining said lamp housing in a selected rotationally adjusted position.

2. The portable utility lamp of claim 1, further comprising end rails extending in parallel relation between said posts.

3. The portable utility lamp of claim 2, further comprising mounting tabs secured to said end rails and mounting said lamp housing.

4. The portable utility lamp of claim 3, further comprising manually actuated clamping bolts extending through each of said mounting tabs and through opposite ends of said lamp housing.

5. The portable utility lamp of claim 1, wherein each of said vertically adjustable posts includes an extensible member received for sliding movement within a stationary tubular member.

6. The portable utility lamp of claim 5, further comprising a coil spring in said stationary tubular member upwardly biasing said extensible member.

7. The portable utility lamp of claim 5, further comprising a plurality of spaced transverse apertures formed through said extensible member for engagement with a transverse retaining pin.

8. The portable utility lamp of claim 1, wherein said lamp housing is configured as an elongated reflector.

9. The portable utility lamp of claim 1, further comprising a pair of handle bars extending along opposite sides of said lamp housing.

10. The portable utility lamp of claim 1, further comprising:

means securing a pair of mounting tabs in vertically aligned horizontally spaced relation for movement with said vertically adjustable posts;

a pair of clamping bolts extending outwardly from opposite ends of said lamp housing, and secured thereto;

a first frictional disk surrounding each of said clamping bolts and secured to said lamp housing;

a second frictional disk surrounding each of said clamping bolts and secured to one of said mounting tabs;

and a manually tightenable clamping nut on each of said clamping bolts for forcing said first and second frictional disks into abutment with a preselected force.

11. The portable utility lamp of claim 10, wherein said lamp housing has a center of gravity disposed along aligned longitudinal axes of said clamping bolts, whereby said lamp housing may be rotated with a minimum of effort.

12. A portable utility lamp, comprising:

a frame;

a pair of vertically adjustable posts mounted in spaced parallel relation on said frame;

a plurality of wheels on said frame;

a lamp housing;

means mounting said lamp housing for vertical adjustment with said posts;

means mounting said lamp housing for rotation about a horizontal axis;

at least one lamp in said housing;

first retaining means for retaining said posts in a selected vertically adjusted position;

a pair of clamping bolts extending outwardly from opposite ends of said lamp housing, and secured thereto;

each of said clamping bolts extending through one of said posts;

a first frictional disk surrounding each of said clamping bolts and secured to said lamp housing;

a second frictional disk surrounding each of said clamping bolts and secured to one of said posts;

and a manually tightenable clamping nut on each of said clamping bolts for forcing said first and second frictional disks into abutment with a preselected force, for retaining said lamp housing in a selected rotationally adjusted position.

13. The portable utility lamp of claim 12, wherein said lamp housing has a center of gravity disposed along aligned longitudinal axes of said clamping bolts, whereby said lamp housing may be rotated with a minimum of effort.

14. The portable utility lamp of claim 12, wherein each of said vertically adjustable posts includes an extensible member received for sliding movement within a stationary tubular member.

15. The portable utility lamp of claim 14, further comprising a coil spring in said stationary tubular member upwardly biasing said extensible member.

16. The portable utility lamp of claim 14, further comprising a plurality of spaced transverse apertures formed through said extensible member for engagement with a transverse retaining pin.

17. The portable utility lamp of claim 12, wherein said lamp housing is configured as an elongated reflector.

* * * * *